US008834122B2

(12) United States Patent
Ingram

(10) Patent No.: US 8,834,122 B2
(45) Date of Patent: Sep. 16, 2014

(54) TURBINE BUCKET ANGEL WING FEATURES FOR FORWARD CAVITY FLOW CONTROL AND RELATED METHOD

(75) Inventor: Clint Luigie Ingram, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 13/282,121

(22) Filed: Oct. 26, 2011

(65) Prior Publication Data

US 2013/0108451 A1 May 2, 2013

(51) Int. Cl.

*F01D 11/04* (2006.01)
*F01D 11/00* (2006.01)
*F01D 5/14* (2006.01)

(52) U.S. Cl.

CPC ..... *F01D 11/001* (2013.01); *F01D 5/145* (2013.01)
USPC ..... 416/191; 416/193 A

(58) Field of Classification Search

USPC ..... 416/193 A, 193 R, 189, 191, 192, 248, 416/239
See application file for complete search history.

(56) References Cited

U.S. PATENT DOCUMENTS

| | | | | |
|---|---|---|---|---|
| 7,114,339 | B2 | 10/2006 | Alvanos et al. | |
| 7,189,055 | B2 * | 3/2007 | Marini et al. | 415/115 |
| 7,465,152 | B2 * | 12/2008 | Nigmatulin | 415/170.1 |
| 7,665,964 | B2 | 2/2010 | Taylor et al. | |
| 8,419,356 | B2 * | 4/2013 | Little | 415/173.1 |
| 2004/0265118 | A1 * | 12/2004 | Naik et al. | 415/116 |
| 2006/0269398 | A1 * | 11/2006 | Marini et al. | 415/115 |
| 2010/0119364 | A1 * | 5/2010 | Bunker | 415/199.5 |
| 2010/0178159 | A1 * | 7/2010 | Bulgrin et al. | 415/170.1 |

* cited by examiner

*Primary Examiner* — Edward Look
*Assistant Examiner* — William Grigos
(74) *Attorney, Agent, or Firm* — Nixon & Vanderhye P.C.

(57) ABSTRACT

A turbine bucket includes a radially inner mounting portion, a shank radially outward of the mounting portion, a radially outer airfoil and a substantially planar platform radially between the shank and the airfoil. At least one axially-extending angel wing seal flange is formed on a leading end of the shank thus forming a circumferentially extending trench cavity along the leading end of the shank, radially between an underside of the platform leading edge and the angel wing seal flange. A plurality of substantially radially grooves are formed on a radially outer surface of the angel wing seal flange and extend into the shank.

19 Claims, 4 Drawing Sheets

TURBINE BUCKET ANGEL WING FEATURES FOR FORWARD CAVITY FLOW CONTROL AND RELATED METHOD

BACKGROUND OF THE INVENTION

The present invention relates generally to rotary machines and, more particularly, to the control of forward wheel space cavity purge flow and combustion gas flow at the leading angel wing seals on a gas turbine bucket.

A typical turbine engine includes a compressor for compressing air that is mixed with fuel. The fuel-air mixture is ignited in a combustor to generate hot, pressurized combustion gases in the range of about 1100° C. to 2000° C. that expand through a turbine nozzle, which directs the flow to high and low-pressure turbine stages thus providing additional rotational energy to, for example, drive a power-producing generator.

More specifically, thermal energy produced within the combustor is converted into mechanical energy within the turbine by impinging the hot combustion gases onto one or more bladed rotor assemblies. Each rotor assembly usually includes at least one row of circumferentially-spaced rotor blades or buckets. Each bucket includes a radially outwardly extending airfoil having a pressure side and a suction side. Each bucket also includes a dovetail that extends radially inward from a shank extending between the platform and the dovetail. The dovetail is used to mount the bucket to a rotor disk or wheel.

As known in the art, the rotor assembly can be considered as a portion of a stator-rotor assembly. The rows of buckets on the wheels or disks of the rotor assembly and the rows of stator vanes on the stator or nozzle assembly extend alternately across an axially oriented flowpath for the combustion gases. The jets of hot combustion gas leaving the vanes of the stator or nozzle act upon the buckets, and cause the turbine wheel (and rotor) to rotate in a speed range of about 3000-15,000 rpm, depending on the type of engine.

As depicted in the figures described below, an axial/radial opening at the interface between the stationary nozzle and the rotatable buckets at each stage can allow hot combustion gas to exit the hot gas path and enter the cooler wheelspace of the turbine engine located radially inward of the buckets. In order to limit this leakage of hot gas, the blade structure typically includes axially projecting angel wing seals. According to a typical design, the angel wings cooperate with projecting segments or "discouragers" which extend from the adjacent stator or nozzle element. The angel wings and the discouragers overlap (or nearly overlap), but do not touch each other, thus restricting gas flow. The effectiveness of the labyrinth seal formed by these cooperating features is critical for limiting the undesirable ingestion of hot gas into the wheelspace radially inward of the angel wing seals.

As alluded to above, the leakage of the hot gas into the wheelspace by this pathway is disadvantageous for a number of reasons. First, the loss of hot gas from the working gas stream causes a resultant loss in efficiency and thus output. Second, ingestion of the hot gas into turbine wheelspaces and other cavities can damage components which are not designed for extended exposure to such temperatures.

One well-known technique for reducing the leakage of hot gas from the working gas stream involves the use of cooling air, i.e., "purge air", as described in U.S. Pat. No. 5,224,822 (Lenehan et al). In a typical design, the air can be diverted or "bled" from the compressor, and used as high-pressure cooling air for the turbine cooling circuit. Thus, the cooling air is part of a secondary flow circuit which can be directed generally through the wheelspace cavities and other inboard rotor regions. This cooling air can serve an additional, specific function when it is directed from the wheel-space region into one of the angel wing gaps described previously. The resultant counter-flow of cooling air into the gap provides an additional barrier to the undesirable flow of hot gas through the gap and into the wheelspace region.

While cooling air from the secondary flow circuit is very beneficial for the reasons discussed above, there are drawbacks associated with its use as well. For example, the extraction of air from the compressor for high pressure cooling and cavity purge air consumes work from the turbine, and can be quite costly in terms of engine performance. Moreover, in some engine configurations, the compressor system may fail to provide purge air at a sufficient pressure during at least some engine power settings. Thus, hot gases may still be ingested into the wheelspace cavities.

Angel wings as noted above, are employed to establish seals upstream and downstream sides of a row of buckets and adjacent stationary nozzles. Specifically, the angel wing seals are intended the prevent the hot combustion gases from entering the cooler wheelspace cavities radially inward of the angel wing seals and, at the same time, prevent or minimize the egress of cooling air in the wheelspace cavities to the hot gas stream. Thus, with respect to the angel wing seal interface, there is a continuous effort to understand the flow patterns of both the hot combustion gas stream and the wheelspace cooling or purge air.

For example, it has been determined that even if the angel wing seal is effective and preventing the ingress of hot combustion gases into the wheelspaces, the impingement of combustion gas flow vortices on the surface of the seal may damage the seal and shorten the service life of the bucket.

The present invention seeks to provide unique angel wing seal and/or bucket platform geometry to better control the flow of secondary purge air at the angel wing interface to thereby also control the flow of combustion gases at that interface in a manner that extends the service life of the angel wing seal and hence the bucket itself.

BRIEF SUMMARY OF THE INVENTION

In one exemplary but nonlimiting embodiment, the invention provides a turbine bucket comprising a radially inner mounting portion, a shank radially outward of the mounting portion, a radially outer airfoil and a substantially planar platform radially between the shank and the airfoil; at least one axially-extending angel wing seal flange on a leading end of the shank thus forming a circumferentially extending trench cavity along the leading edge of the shank, radially between an underside of the platform leading end and the angel wing seal flange; and a plurality of grooves formed on a radially outer surface of the angel wing seal flange and extending into the shank.

In another aspect, the invention provides a turbine wheel supporting a circumferentially arranged row of buckets, each bucket comprising: a radially inner mounting portion, a shank radially outward of the mounting portion, a radially outer airfoil and a substantially planar platform radially between the shank and the airfoil; at least one axially-extending angel wing seal flange on a leading end of the shank thus forming a circumferentially extending trench cavity along the leading edge of the shank, radially between an underside of the platform leading edge and the angel wing seal flange; and wherein a plurality of substantially radially-extending grooves are formed on radially outer surface of said angel wing seal flange at least partially defining said trench cavity and bridging an interface between said angel wing seal flange and said shank.

In still another aspect, the invention provides a method of controlling secondary flow at a radial gap between a rotating turbine wheel mounting a plurality of buckets and an adjacent nozzle, the method comprising locating at least one angel wing seal on a leading end of each of the plurality of buckets extending axially toward the nozzle to thereby form a barrier between a hot stream of combustion gases on a radially outer side of the angel wing seal and purge air in a wheel space radially inward of the at least one angel wing seal; and providing plural grooves in the angel wing seal facilitating purge air flow into an area radially outward of the angel wing seal flange to thereby prevent the combustion gases from impinging on the angel wing seal flange.

The invention will now be described in detail in connection with the drawings identified below.

DETAILED DESCRIPTION OF THE INVENTION

Figure 1:
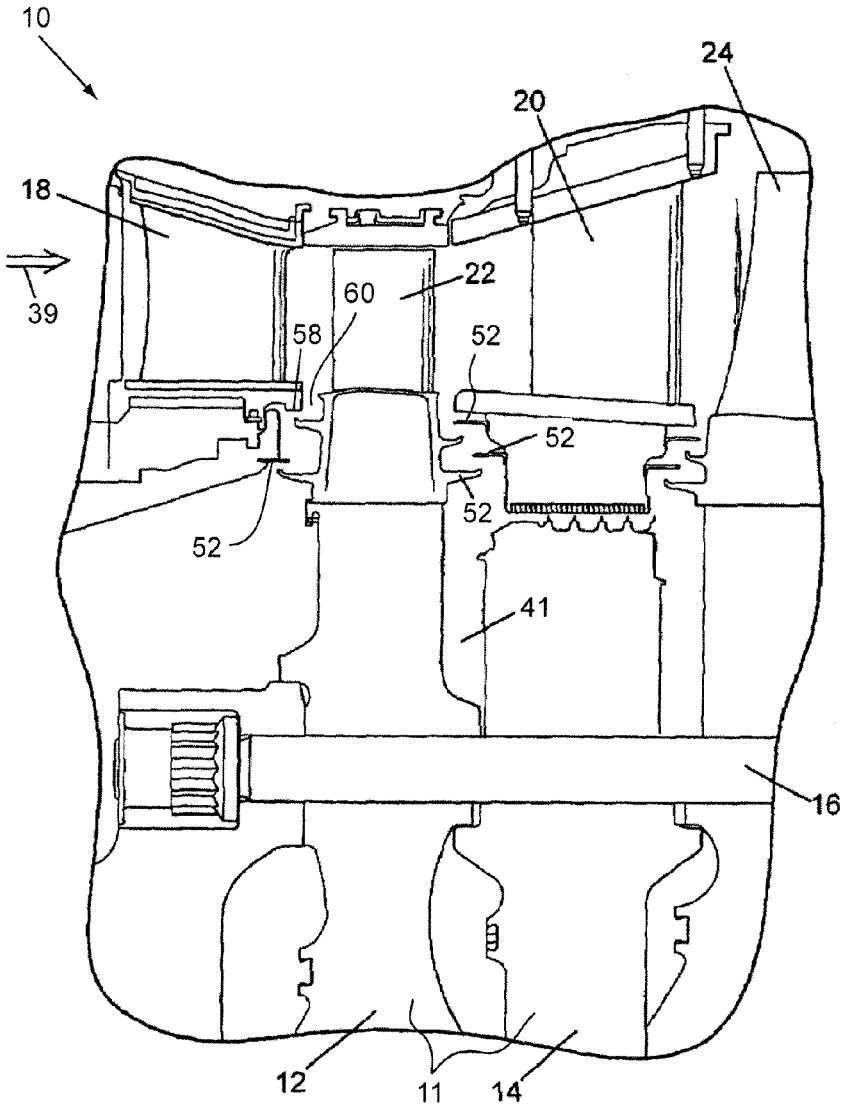
FIG. 1 (PRIOR ART)
FIG. 1 is a is a fragmentary schematic illustration of a cross-section of a portion of a turbine.

FIG. 1 schematically illustrates a section of a gas turbine, generally designated 10, including a rotor 11 having axially spaced rotor wheels 12 and spacers 14 joined one to the other by a plurality of circumferentially spaced, axially-extending bolts 16. Turbine 10 includes various stages having nozzles, for example, first-stage nozzles 18 and second-stage nozzles 20 having a plurality of circumferentially-spaced, stationary stator blades. Between the nozzles and rotating with the rotor and rotor wheels 12 are a plurality of rotor blades, e.g., first and second-stage rotor blades or buckets 22 and 24, respectively.

Figure 2:
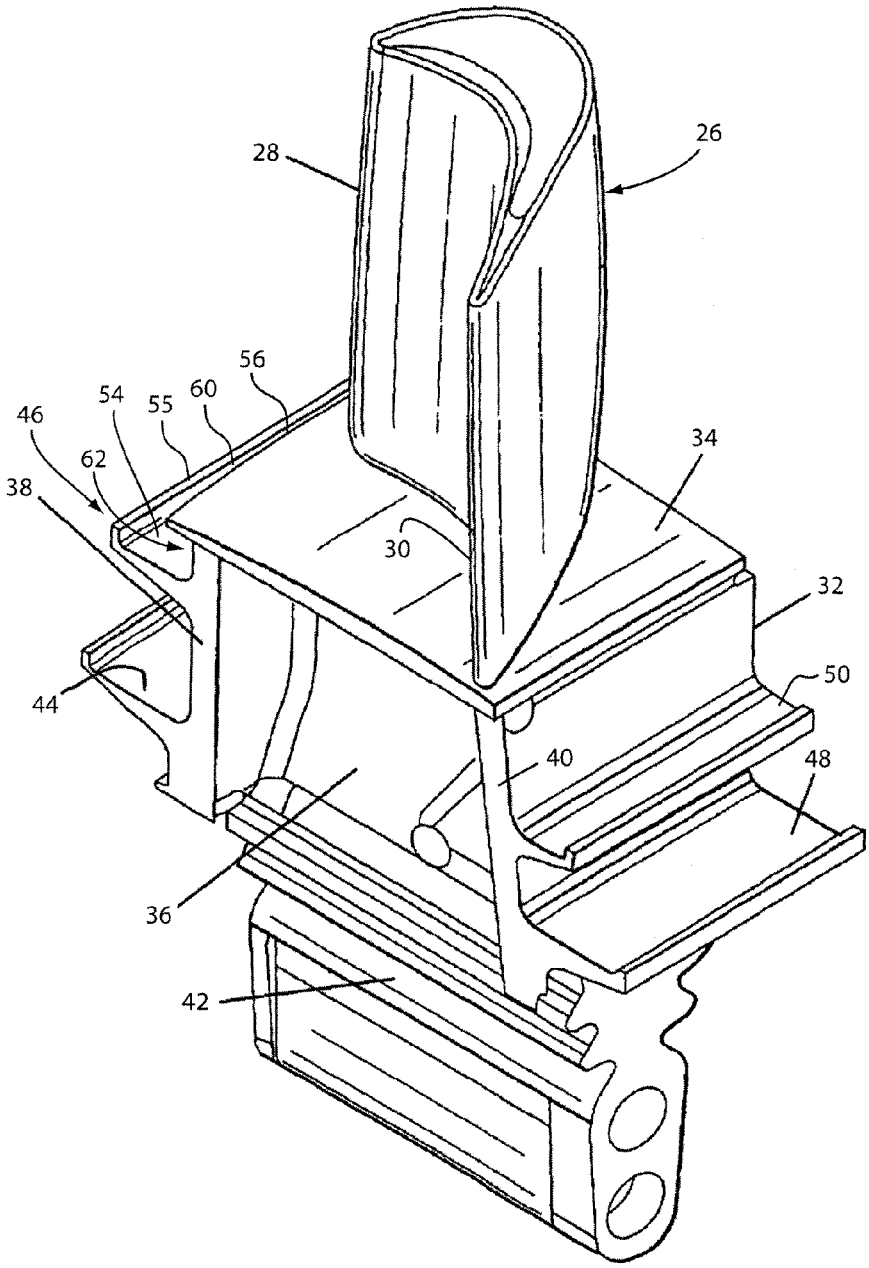
FIG. 2 (PRIOR ART)
FIG. 2 is an enlarged perspective view of a turbine blade.

Referring to FIG. 2, each bucket (for example, bucket 22 of FIG. 1) includes an airfoil 26 having a leading edge 28 and a trailing edge 30, mounted on a shank 32 including a platform 34 and a shank pocket 36 having integral cover plates 38, 40. A dovetail 42 is adapted for connection with generally corresponding dovetail slots formed on the rotor wheel 12 (FIG. 1). Bucket 22 is typically integrally cast and includes axially projecting angel wing seals 44, 46 and 48, 50. Seals 46, 48 and 50 cooperate with lands 52 (see FIG. 1) formed on the adjacent nozzles to limit ingestion of the hot gases flowing through the hot gas path, generally indicated by the arrow 39 (FIG. 1), from flowing into wheel spaces 41.

Of particular concern here is the upper or radially outer angel wing seal 46 on the leading edge end of the bucket. Specifically, the angel wing 46 includes a longitudinal extending wing or seal flange 54 with an upturned edge 55. The bucket platform leading edge 56 extends axially beyond the cover plate 38, toward the adjacent nozzle 18. The upturned edge 55 of seal flange 54 is in close proximity to the surface 58 of the nozzle 18 thus creating a tortuous or serpentine radial gap 60 as defined by the angel wing seal flanges 44, 46 and the adjacent nozzle surface 58 where combustion gas and purge air meet (see FIG. 1). In addition, the seal flange 54 upturned edge 55 and the edge 56 of platform 34 form a so-called "trench cavity" 62 where cooler purge air escaping from the wheel space interfaces with the hot combustion gases. As described further below, by maintaining cooler temperatures within the trench cavity 62, service life of the angel wing seals, and hence the bucket itself, can be extended.

In this regard, the rotation of the rotor, rotor wheel and buckets create a natural pumping action of wheel space purge air (secondary flow) in a radially outward direction, thus forming a barrier against the ingress of the higher temperature combustion gases (primary flow). At the same time, CFD analysis has shown that the strength of a so-called "bow wave," i.e., the higher pressure combustion gases at the leading edge 28 of the bucket airfoil 26, is significant in terms of controlling primary and secondary flow at the trench cavity. In other words, the higher temperature and pressure combustion gases attempting to pass through the angel wing gap 60 is strongest at the platform edge 56, adjacent the leading edge 28 of the bucket. As a result, during rotation of the wheel, a circumferentially-undulating pattern of higher pressure combustion gas flow is established about the periphery of the rotor wheel, with peak pressures substantially adjacent each the bucket leading edge 28.

As discussed above, the radially outer angel wing seal flange 54 is intended to block or at least substantially inhibit hot combustion gases from entering the wheel space cavity, noting the close proximity between the radially outer seal wing flange 54 and the fixed nozzle surface 58, best seen in FIG. 1. The invention here provides a modification to the radially outer angel wing seal flange 54 that allows purge air from the radially inner turbine wheelspace to prevent the hot combustion gas flow from impinging on the seal flange, thus reducing the flange temperature and extending the service life of the flange and hence the bucket.

Figure 3:
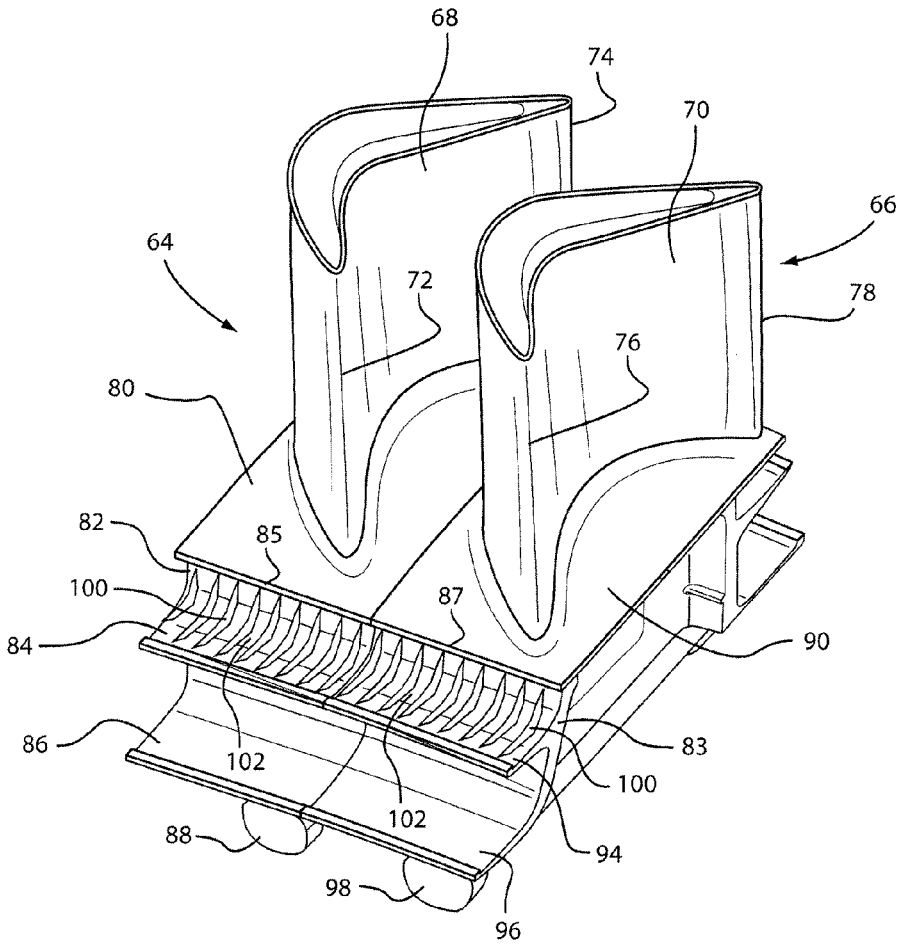
FIG. 3 is a perspective view of a turbine bucket pair illustrating an angel wing seal flange in accordance with an exemplary but nonlimiting embodiment of the invention.

As best seen in FIG. 3, a pair of buckets 64, 66 is arranged in side-by-side relationship and include airfoils 68, 70 with leading and trailing edges 72, 74 and 76, 78 respectively. The bucket 64 is also formed with a platform 80, shank 82 supporting inner and outer angel wing seal flanges 84, 86 at the leading end of the bucket, and a dovetail 88. Similarly, the bucket 66 is formed with a platform 90, shank 92 supporting angel wing seal flanges 94, 96 and a dovetail 98. Similar angel wing seals are provided on the trailing sides or ends of the buckets but are no of concern here.

In an exemplary but nonlimiting embodiment, a plurality of substantially parallel grooves 100 are formed in the angel wing seal flanges 84, 94, extending substantially axially along the seal flanges 84, 94 and substantially radially along the respective shanks 82, 83 of the buckets. The grooves 100 may be machined or etched in the seal flanges and shank surfaces such that, in effect, "vanes" 102 are formed between adjacent grooves. The grooves/vanes extend across the seal flanges 84, 94 and along the shanks 82, 83 to the underside of the leading edges 85, 87 of the platforms 80, 90. The vane-like entities (or simply, "vanes") and adjacent grooves 100 may be curved to aid in developing a counter-clockwise flow structure that is fed by the cool purge flow over the angel wing flanges 84, 94, effectively blocking the clockwise combustion of vortices above. In other words, the grooves/vanes increase the disk-pumping of purge air as described above.

The number and pattern of groove/vanes may be varied along the buckets mounted about the circumference of the turbine disk or wheel. For example, one or more grooves may be located adjacent the bucket airfoil leading edges 72, 76 where peak static pressures are greatest.

It will also be appreciated that the size, shape, length, etc. of the grooves/vanes may vary along with the uniformity or non-uniformity of the pattern about the circumference of the turbine disk or wheel, depending on specific turbine applications.

Figure 5:
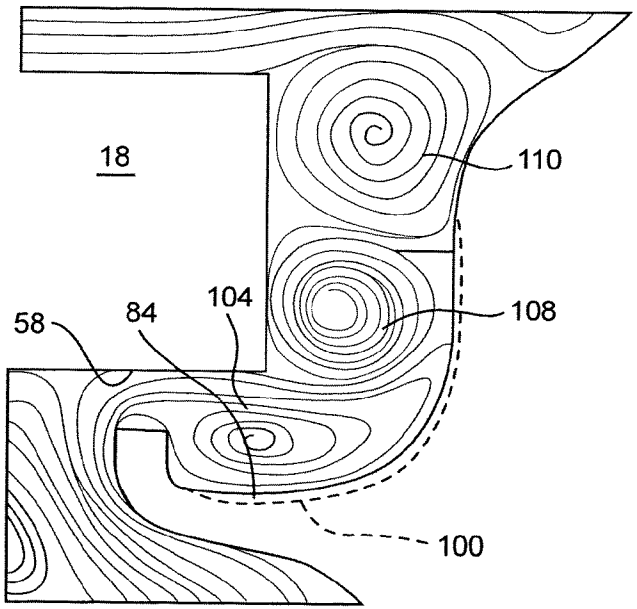
FIG. 5 a view similar to FIG. 4 but illustrating a modified seal flange in accordance with an exemplary but nonlimiting embodiment of the invention and the resultant effect on the combustion gas and purge air vortices.
Figure 4:
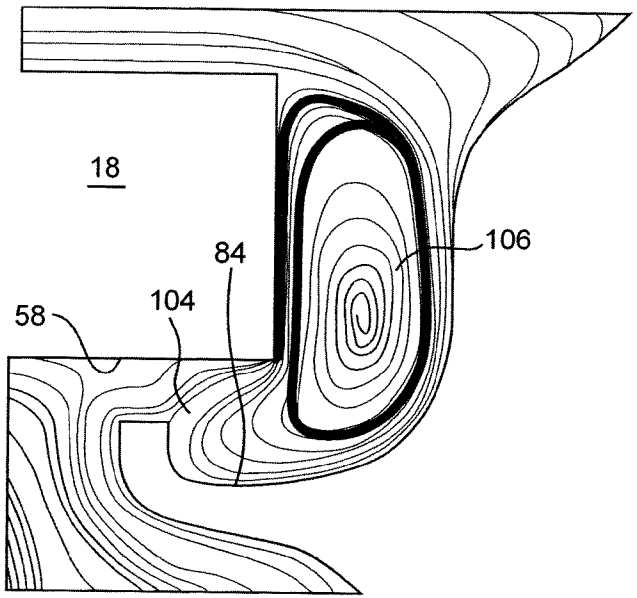
FIG. 4 is a partial schematic view of a known leading end angel wing seal flange and a depiction of the interaction between combustion gases and purge air in a gap between the seal flange and an adjacent nozzle surface.

FIGS. 4 and 5 illustrate the enhanced flow development attributable to the use of the grooves 100/vanes 102. In FIG. 4, it can be seen that the cool purge air represented by flow lines 104 is somewhat effective in preventing the hot combustion gas vortices 106 from directly impinging on the seal flange 84. FIG. 5 illustrates enhanced purge air flow development through the use of the groove/vanes described above. Now, the purge air flow 104 also forms vortices 108 radially outwardly of the seal flange 84 which push the hot gas vortices 110 further away from the seal flange.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

a radially inner mounting portion, a shank radially outward of the mounting portion, a radially outer airfoil and a substantially planar platform radially between the shank and the airfoil;

at least one axially-extending angel wing seal flange on a leading end of the shank thus forming a circumferentially extending trench cavity along the leading end of the shank, radially between an underside of the platform leading edge and the angel wing seal flange; and a plurality of grooves formed on a radially outer surface of said angel wing seal flange and extending into said shank, wherein in the grooves extend axially without a curve along their length on the outer surface of the angel wing seal flange.

2. The turbine bucket of claim 1 wherein said plurality of grooves are substantially uniformly distributed in a circumferential direction along said trench cavity.

3. The turbine bucket of claim 1 wherein said plurality of grooves define plural circumferentially-spaced, fins, to promote purge air flow within said trench cavity.

4. The turbine bucket of claim 2 wherein said plurality of grooves define plural circumferentially-spaced, fins, to promote purge air flow within said trench cavity.

5. The turbine bucket of claim 1 wherein said plurality of grooves are substantially non-uniformly distributed in a circumferential direction along said trench cavity.

6. The turbine bucket of claim 5 wherein said plurality of grooves define plural circumferentially-spaced, fins are to promote purge air flow within said trench cavity.

7. The turbine bucket of claim 1 wherein a second axially-extending angel wing seal flange is located radially inwardly of said at least one axially-extending angel wing seal flange.

8. A turbine wheel supporting a circumferentially arranged row of buckets, each bucket comprising:

a radially inner mounting portion, a shank radially outward of the mounting portion, a radially outer airfoil and a substantially planar platform radially between the shank and the airfoil;

at least one axially-extending angel wing seal flange on a leading end of the shank thus forming a circumferentially extending trench cavity along the leading edge of the shank, radially between an underside of the platform leading end and the angel wing seal flange; and wherein a plurality of substantially radially-extending grooves are formed on radially outer surface of said angel wing seal flange at least partially defining said trench cavity and bridging an interface between said angel wing seal flange and said shank, and wherein in the grooves extend axially without a curve along their length on the outer surface of the angel wing seal flange.

9. The turbine wheel of claim 8 wherein said plurality of grooves are substantially uniformly distributed in a circumferential direction along said trench cavity.

10. The turbine wheel of claim 8 wherein said plurality of grooves are substantially non-uniformly distributed in a circumferential direction along said trench cavity.

11. The turbine wheel of claim 8 wherein said plurality of grooves form fins between said grooves, to promote purge air flow within said trench cavity.

12. The turbine wheel of claim 9 wherein said plurality of grooves form fins between said grooves, to promote purge air flow within said trench cavity.

13. The turbine wheel of claim 10 wherein said plurality of grooves form fins between said grooves, to promote purge air flow within said trench cavity.

14. The turbine wheel of claim 10 wherein a second axially-extending angel wing seal flange is located radially inwardly of said at least one axially-extending angel wing seal flange.

15. A method of controlling secondary flow at a radial gap between a rotating turbine wheel mounting a plurality of buckets and an adjacent nozzle, the method comprising:

locating at least one angel wing seal on a leading end of each of said plurality of buckets extending axially toward said nozzle to thereby form a barrier between a hot stream of combustion gases on a radially outer side of said angel wing seal and purge air in a wheel space radially inward of said at least one angel wing seal; and providing plural grooves in said angel wing seal facilitating purge air flow into an area radially outward of said angel wing seal flange to thereby prevent the combustion gases from impinging on said angel wing seal flange, wherein in the grooves extend axially without a curve along their length on the outer surface of the angel wing seal flange.

16. The method of claim 15 including uniformly distributing said plural grooves along said angel wing seal.

17. The method of claim 15 including non-uniformly distributing said plural grooves along said angel wing seal.

18. The method of claim 15 wherein said plural grooves extend into an adjacent shank of each of said plurality of buckets.

19. The method of claim 16 wherein said plural grooves are machined or etched in said angel wing seal.

* * * * *